United States Patent [19]

Schena

[11] 4,014,637

[45] Mar. 29, 1977

[54] CATALYST GENERATOR

[76] Inventor: Kenneth R. Schena, Silvermine Road, West Boxford, Mass. 01855

[22] Filed: Mar. 1, 1976

[21] Appl. No.: 662,829

[52] U.S. Cl. ..... 431/4; 261/18 B; 261/30; 261/121 R

[51] Int. Cl.[2] ..... F23J 7/00

[58] Field of Search ..... 431/4, 126, 190, 3; 137/3, 423; 261/18 B, 30, 121 R

[56] References Cited

UNITED STATES PATENTS

| | | | |
|---|---|---|---|
| 3,766,942 | 10/1973 | Delatronchette | 431/6 X |
| 3,862,819 | 1/1975 | Wehtworth | 431/4 |
| 3,924,648 | 12/1975 | Etter | 431/4 X |

*Primary Examiner*—Edward G. Favors
*Attorney, Agent, or Firm*—Sewall P. Bronstein; David G. Conlin

[57] ABSTRACT

Apparatus and method for improving the efficiency of combustion in burners is disclosed. Air is circulated at a substantially constant controlled rate from a blower or compressor through a control valve to a release point beneath a catalyzing or catalyst-forming liquid, such as water, and is released beneath such surface in such a manner as to ensure the slow growth of relatively large bubbles. These bubbles break at the liquid surface, and the catalyst-laden air is then returned to the gas impelling means, in which it is mixed with more air and returned to the system. A portion of the catalyst-laden air is directed to the combustion device, e.g. the oil burner, at a point between the air impelling means and the bubble chamber, preferably at a point between the air impelling device and the first control valve.

11 Claims, 3 Drawing Figures

CATALYST GENERATOR

BACKGROUND OF THE INVENTION

This invention relates to the improvement of combustion in fuel-burning devices, more particularly to the improvement of efficiency of liquid fossil fuel burning systems such as oil burners, e.g. those used in home and/or industrial heating units.

It is known that combustion devices which burn hydrocarbon fuels generally are more efficient and economical when supplied with moisture-laden air or droplets of water suspended in air to the manifold to be mixed with the vaporized fuel. See, e.g., U.S. Pat. No. 1,618,602, Meyers, U.S. Pat. No. 1,775,263, Wiegland, and U.S. Pat. No. 3,814,567, Zink. The reason for the increase in combustion efficiency is unclear. It has been postulated that the water vapor acts catalytically to aid in combustion, since water is a reaction product from the combustion of hydrocarbon fuels, and the presence of reaction product in a reaction medium would generally be expected to drive the reaction in the opposite direction or at least slow it down. See U.S. Pat. No. 3,862,819 to Wentworth. Others, such as Zink, supra, have suggested that the water acts as a source of hydrogen which aids in more complete combustion of the carbon. Some have bubbled air through a water layer which is coated with a layer of oil or other hydrocarbon before injecting it into the combustion zone, e.g. Wentworth, supra, and U.S. Pat. No. 1,618,602 to Meyers et al. In such systems, it is possible that the water reacts with other components in the system to produce catalysts or more highly reactive fuels. At any rate, whatever the precise mechanism by which the efficiency is increased, some increase in efficiency has been previously recognized.

Yet in spite of the fact that this phenomenon has long been known, no device which employs the phenomenon to improve the efficiency of oil burners, for example, has been commercially adopted by the industry. The reason for this is believed to be that previously known devices for infusing water vapor or other catalytic vapors into the combustion mixture have not proven to result in the expected increase in efficiency and performance on a dependable basis.

In the Wentworth patent discussed above, there is disclosed a device which utilized the oil burner blower itself to force a portion of the combustion air to bubble through a water layer, preferably covered with a layer of oil. In that device, two taps are made and tubes are inserted into the housing of the oil burner blower, one in order to supply air under pressure to a dip tube extending beneath the surface of a water supply in a container, and another connected to the oil burner blower in such a manner as to obtain a vacuum, and connected to the water container above the water level, so as to apply that vacuum and obtain a pressure differential between the air in the dip tube and the air above the liquid level, thus aiding in the passage of air through the liquid. The Wentworth apparatus imposes a drain on the efficiency of the burner blower, and provides little control over the contact rate between the air and the water. It has been found in practice that the Wentworth system is undependable and erratic in operation, and does not provide adequate increase in performance or savings in fuel cost.

It is accordingly an object of the present invention to provide an apparatus which is effective in decreasing fuel consumption and improving performance of liquid fuel burners.

It is a further object of this invention to provide such a device which provides consistent improvements in performance and fuel consumption over a wide range of operating conditions.

It is a further object to provide such a device in which the operation of the device is easily and precisely controlled and adjusted to maximize its effect, such device being easy to manufacture, install and use.

It is a particular object of this invention to decrease fuel consumption and improve performance of oil burners of the type used in heating equipment.

It is a still further object to provide a method of improving the combustion of hydrocarbon fuels, such as petroleum or fractions or derivations of petroleum.

These and other objects and advantages which will be appreciated by the skilled in the art from consideration of the present specification or from a practice of the invention disclosed in the following description taken in connection with the annexed drawings in which.

BRIEF SUMMARY OF THE INVENTION

Figure 3:
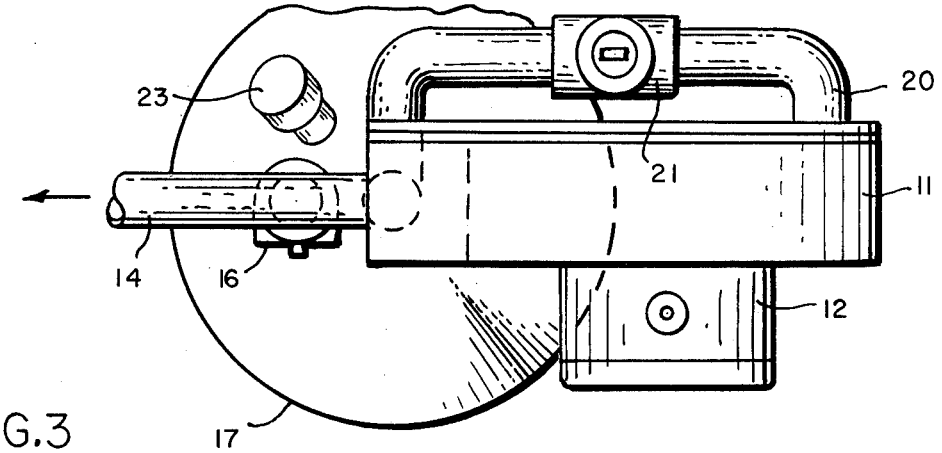
FIG. 3 is a top view of the device of FIG. 2.

In accordance with the present invention, it has been surprisingly found that large and consistent improvements in fuel consumption and performance can be obtained by bubbling air through a chamber containing the liquid which comprises the material which is desired to be infused into the reaction atmosphere, or a liquid which will react to provide such material, at a substantially constant, controlled rate in a self-contained device which is independent of the burner blower. The resulting treated air, laden with the material to be infused, is then wholly or partially conducted to the intake for combustion air in the fuel-burning device, e.g. within the burner blower, where it is mixed with other air before combustion.

Basically, the system is a self-contained unit which comprises a constant speed blower or compressor or some other means for circulating the air under pressure which is separate from the oil burner itself, an outlet conduit for carrying the air from the blower and transporting it to the hydrocarbon burning device, a bubbler conduit which diverts some portion of the air from the blower through a contact or bubbler chamber, a valve in the bubbler conduit for varying the rate of bubbling, the bubbler chamber for contacting the air with the source of catalyst, and a return conduit for carrying the catalyst-laden air back to the blower, from which it is carried to the oil burner via the outlet conduit. The return line may also include a valve, which aids in precisely controlling the rate of feed through the bubbler chamber. In a further preferred embodiment the size and rate of the bubbles formed in the chamber is controlled by sizing the outlet of the bubbler pipe, or by providing a large diameter end piece on the bubbler pipe, so as to form larger, more slowly growing bubbles, which contact the fluid longer because of this slow growth. This discovery is in striking contrast to the beliefs of the prior art, e.g. Mills, U.S. Pat. No. 3,767,172, Stover, U.S. Pat. No. 1,960,982 and Stephenson et al., U.S. Pat. No. 3,790,139, who found it important to have their devices produce miriads of very small bubbles. Preferably the bubbler tube is adapted to provide bubbles in the order of ½ to 1½ inches in diameter, more preferably from about ½ to 1 inch in diameter, most preferably about ¾ inch in diameter.

The constant flow system of the present invention produces increased and more consistent improvements in combustion efficiency, as compared with systems which increase the output of treated air in response to increased demands. Without wishing to be bound by the theory of operation of this device, it is believed that its improved performance is obtained, at least in part, because of the close control it provides over the rate of bubble production and the nature of the bubbles which are formed. Preferably the present invention utilizes means for controlling air flow both in the feed line to the bubble chamber and in the exit line from the bubble chamber. Preferably valves, such as ball valves, needle valves, butterfly valves or gate valves, are used as these flow controllers, but other known means such as sized orifices can also be used. Preferably at least one of these lines retains adjustable means for controlling gas flow. Thus, for example, where there is uniformity in the demand which the device will face, e.g. where the unit is specifically designed for a steady, constant rate oil burner, the valve in the exit line can be replaced with a sized orifice, or even the size of the piping can be designed for the system so that the valve in the exit line can be dispensed with. However in such cases the valve in the bubbler line is retained. Utilizing the dual control system, both the amount of pressure transmitted to the bubbler input from the output side of the gas supply device and the amount of vacuum applied to the bubbler output, e.g. from the suction side of the gas supply device, can be controlled relatively precisely.

The present device provides a self-contained source of catalyst-containing air under substantially constant pressure, in contrast with previously known systems, which depended on the combustion system they were used with to provide the catalyst-containing air. Thus in Wentworth, for example, the air supply power of the burner blower itself was tapped to obtain the feed for the bubbler chamber.

In the present device, a separate air supplying means is provided, and the output from the device is blown directly into the oil burner blower. Instead of reacting to the increased air flow as if the fuel/air mixture were too lean, i.e. an excess of the air for the amount of fuel fed, the oil burners to which the device of the present invention are attached react as if the fuel/air mixture were too rich, even though the fuel is fed at the same rate and the amount of air fed is actually somewhat higher. Further, measurements have shown that when ordinary oil burners are equipped with the device of the present invention, the flame temperature and heating efficiency are substantially increased. The net results are a substantial and consistent decrease in fuel consumption, not only over the ordinary oil burner without any catalytic device, but even over the oil burner equipped with the Wentworth device.

To install and use the device of the present invention, one simply taps the output line of the device into the squirrel cage or cover of the oil burner blower at a convenient location and ties the power supply of the air supply device of the present invention to the power supply for the oil burner, so that the device operates during the time the burner is activated, e.g. in response to a thermostatic control.

Figure 2:
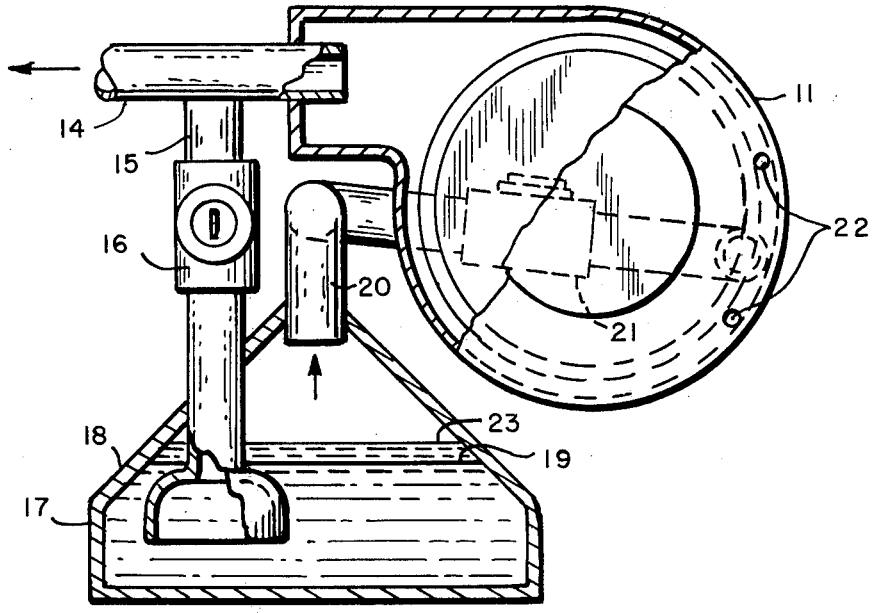
FIG. 2 is a plan view, partially in section, of one embodiment of the device.
Figure 1:
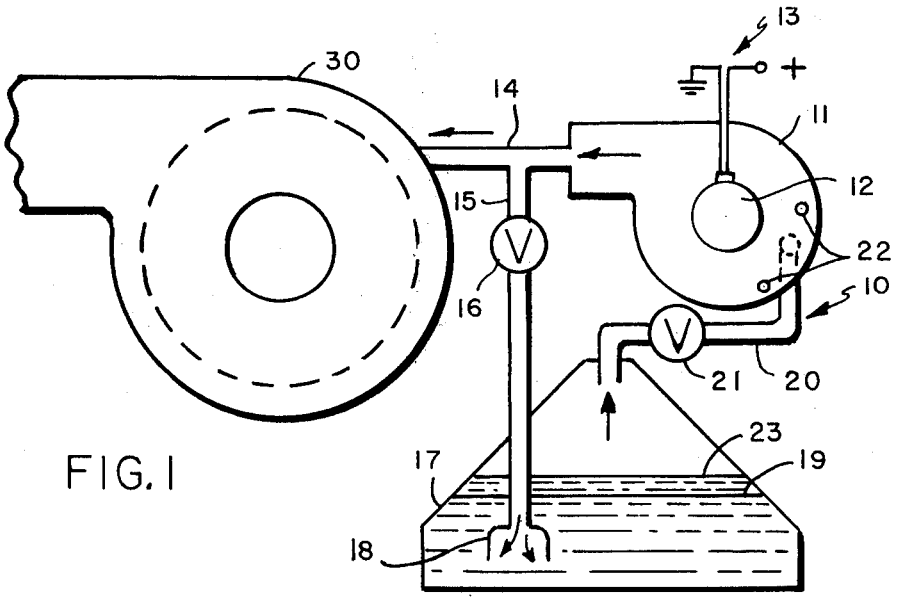
FIG. 1 is a schematic presentation of the device operatively connected to a common type oil burner, showing its various component parts and their interconnections.

Turning to the drawings, FIG. 1 shows a schematic drawing of one embodiment of the invention, generally indicated at 10, in which blower 11 has a motor 12 which is operatively connected to a source of electrical energy 13. The output of the blower exits through line 14, and part of it passes to the catalyst generating system via bubbler line 15, and the remainder passes on through conduit 14 to the squirrel cage or cover of the oil burner blower the system is being used with. Valve 16 is used to control the amount of gas which is carried through the bubbler system. Bubbler line 15 passes through the upper wall of bubbler chamber 17 and terminates beneath the surface 19 of the water or other liquid, so that the air passing through line 15 bubbles up through that liquid. Preferably bubbler 15 terminates in a cup-shaped member such as at 18, which provides large bubbles, the importance of the bubble size being discussed below. Bubbler chamber 17 is preferably covergent as the air exit is approached to aid in collection of the gas and minimize the surface of the liquid at which turbulence might cause entrainment of large amounts of liquid into the exit tube 20. The coverging surface can be conical or fursto-conical, as shown in FIGS. 2 and 3, or the converging portion may have flat sides, making it generally pyramidal in shape, as is shown, for example, in Wentworth, U.S. Pat. No. Des. 235,448.

The catalyst-laden air exits through tube 20 to be fed into the housing of the compressor or blower 11. Preferably line 20 contains a valve 21, as shown in FIGS. 1–3, which permits control of the amount of vacuum applied from the intake side of blower 11, so that more precise control of the rate of withdrawal of the catalyst-laden air from the bubbler chamber 17 can be achieved. This dual control feature is particularly advantageous in the embodiments of the invention which are not specifically designed to use on standard sized oil burners, or where the burner on which it is to be used operates under a variety of different conditions. The dual control system makes it relatively simple to adapt the system to a variety of burners and to tune the device for maximum running efficiency on such burners.

Holes 22 in the periphery of the cover of blower 11 bring in outside air which mixes with the air within the blower and makes up for the volume of catalyst-containing air which is delivered to the combustion device 30 through line 14.

Preferably the contact or bubbler chamber 17 contains water, and the water surface 19 is covered with a layer 23 of non-miscible oil which reduces the amount of surface turbulence, and may add to the catalytic or combustion-supporting nature of the product formed. Non-miscible motor oils or other petroleum based oils may be used, as may non-miscible oils from other sources, e.g. vegetable or other natural oils, or silicone oils.

As previously indicated, contrary to prior belief, it has been found important to adapt the device to produce large, slowly growing bubbles at a steady rate. For this purpose, the exit port of the bubbler tube 15 beneath the surface of the liquid in the contact chamber is sized, or a large diameter end piece 18 is provided, so as to form relatively large bubbles which grow over a relatively substantial period of time. Preferably the exit port is sized so that the average bubble size is between about 0.4 and 1.5 inches, more preferably between about 0.5 and 1.0 inch and most preferably between 0.6 and 0.85 inch. Further, the gas flow is regulated in such a system so that the bubbles form at a rate of from about two bubbles per second to about one bubble every 2 seconds, preferably an average rate of about one bubble every 0.8 to 1.2 seconds.

Further, it preferred that the system be designed so that the amount of catalyst-laden air supplied to the burner comprises from about 0.005 to about 10.0% by volume of the total combustion air supplied to the burner. Most preferably the amount of catalyst-laden air is from about 0.02 to 0.2% by volume of the total combustion air. Quite surprisingly, improvement in fuel economy of up to 27% has been achieved with the present invention, with levels of catalyst-laden air of only about 0.1% by volume.

The device of the present invention is usable with liquids other than water, or water with a supernatent oil layer. An aqueous solution contains other ingredients, such as corrosion inhibitors, buffers, defoaming agents, surface active agents, antifreeze ingredients, as well as water miscible ingredients which may also be picked up by the air being contacted and may aid in burning or may themselves be burned. Where a supernatent non-miscible layer is used, it too may contain one or more of such ingredients, but care should be taken that neither layer contains ingredients of a type or quantity to substantially adversely affect the non-miscibility of the two layers. Suitable buffering additives include weak acids, bases and salts thereof, e.g. boric, carbonic, phosphoric, phosphorous, sulphurous acids or alkali and/or alkaline earth metal salts thereof, ammonium hydroxide or halide, sulfate, etc., salts thereof, or basic amines or hydrazine. Water miscible lower molecular weight organic acids, e.g. formic acid, acetic acid, citric acid, malic acid, oxalic acid, etc., may also be used to advantage. Suitable antifreeze ingredients include lower molecular weight alcohols and polyols, e.g. methanol, ethanol, isopropanol, ethylene glycol, propylene glycol, glycerine, etc. Suitable anti-corrosion, antifoaming and surface active agents are known in the art. Dyes or other ingredients may also be added. These ingredients may be added to the liquid or in some instances can be formed in situ.

The device can also be used with non-aqueous liquids, e.g. with gasoline, kerosine, organic cleaners, catalysts or other materials.

The device is preferably made of corrosion resistant metal, but other materials such frusto-conical, plastics may be used.

While particular embodiments of the present invention have been described, they are intended to be exemplary only, with the true scope and spirit of the invention being indicated in the following claims.

I claim:

1. Apparatus for supplying catalyst to the blower of a liquid fuel combustion device, comprising gas impeller means for moving gas under pressure, a first conduit means connecting the output of the gas impeller means to the blower, second conduit means connected to said first conduit means at one end, and connected at the other end to a chamber means for contact of the gas carried by said second conduit means with a liquid, and third conduit means connected between said chamber means and said gas impeller means for feeding the gas treated in said chamber means into said gas impeller means.

2. The apparatus of claim 1, wherein said second conduit means includes a valve for controlling the flow of the gas carried thereby.

3. The apparatus of claim 2, wherein the third conduit means includes a valve for controlling the flow of the gas carried thereby.

4. The apparatus of claim 2, wherein said second conduit means comprises a tube which extends below the level of liquid in said chamber, said tube having a discharge opening which is sized to provide bubbles of an average size of from about 0.4 to 1.5 inches in diameter.

5. The apparatus of claim 4, wherein the discharge opening is sized to provide bubbles of an average size of from about 0.6 to 0.85 inch.

6. The apparatus of claim 4 wherein the valve in said first conduit means is adjustable to provide a bubble formation rate at the discharge opening of from about two bubbles per second to about one bubble per 2 seconds.

7. The apparatus of claim 2, the capacity of said gas impelling device being sufficient to supply between about 0.02 and 0.2% by volume of the combustion air supplied to said liquid fuel combustion device.

8. The apparatus of claim 2, wherein said liquid fuel combustion device is an oil burner.

9. The apparatus of claim 2, wherein said gas impeller means comprises a blower.

10. The apparatus of claim 2 wherein said gas impeller means comprises a compressor.

11. A method of improving combustion in an oil burner having a blower comprising feeding air through a gas impelling device, diverting part of the output air from said gas impelling device to a dip tube which extends beneath the surface of an aqueous liquid, bubbling said gas through said aqueous liquid in the form of bubbles having a diameter of about 0.6 to 0.85 inches at the rate of one bubble about ever 0.8 to 1.2 seconds, feeding said bubbled air to the gas impelling device, and feeding the non-diverted part of the output air from said gas impelling device into the oil burner blower.

* * * * *